US008463166B2

(12) United States Patent
Ueno et al.

(10) Patent No.: US 8,463,166 B2
(45) Date of Patent: Jun. 11, 2013

(54) FIXING DEVICE AND IMAGE FORMING APPARATUS

(75) Inventors: Satoshi Ueno, Tokyo (JP); Masanao Ehara, Kanagawa (JP); Tadashi Ogawa, Tokyo (JP); Hiroshi Seo, Kanagawa (JP); Takamasa Hase, Kanagawa (JP); Takahiro Imada, Kanagawa (JP); Shuutaro Yuasa, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 206 days.

(21) Appl. No.: 13/064,105

(22) Filed: Mar. 7, 2011

(65) Prior Publication Data

US 2011/0222926 A1 Sep. 15, 2011

(30) Foreign Application Priority Data

Mar. 12, 2010 (JP) ..... 2010-055822

(51) Int. Cl.
*G03G 15/20* (2006.01)

(52) U.S. Cl.
USPC ..... 399/323; 399/122; 399/328

(58) Field of Classification Search
USPC ..... 399/322, 323, 328, 329, 122, 124
See application file for complete search history.

(56) References Cited

U.S. PATENT DOCUMENTS 4,065,120 A * 12/1977 Imaizumi et al. ..... 399/323 X
4,375,327 A * 3/1983 Matsumoto et al. ..... 399/323
5,548,389 A * 8/1996 Bowler, Jr. ..... 399/323 X
5,589,925 A * 12/1996 Cahill ..... 399/323
6,650,862 B2 * 11/2003 Nakano et al. ..... 399/323
7,734,218 B2 * 6/2010 Oohata et al. ..... 399/122
2001/0036377 A1 * 11/2001 Tsujihara ..... 399/322

FOREIGN PATENT DOCUMENTS

JP 51-109739 U 9/1976
JP 63-313182 A 12/1988
JP 01-263679 A 10/1989
JP 11-174890 A 7/1999
JP 2008-065042 A 3/2008

* cited by examiner

*Primary Examiner* — Sophia S Chen
(74) *Attorney, Agent, or Firm* — Harness, Dickey & Pierce, P.L.C.

(57) ABSTRACT

A fixing device includes an image surface side separating member that separates a recording medium from a fixing member; an image surface side conveyance guiding member arranged downstream of the image surface side separating member; a non-image surface side separating member that separates the recording medium from a pressing member; and a non-image surface side conveyance guiding member arranged downstream of the non-image surface side separating member. When the image surface side conveyance guiding member is rotated about its rotation axis so as to be opened or closed, the image surface side separating member is also rotated or slid so as to be opened or closed simultaneously. When the non-image surface side conveyance guiding member is rotated about its rotation axis so as to be opened or closed, the non-image surface side separating member is also rotated or slid so as to be opened or closed simultaneously.

11 Claims, 5 Drawing Sheets

FIXING DEVICE AND IMAGE FORMING APPARATUS

CROSS-REFERENCE TO RELATED APPLICATIONS

The present application claims priority to and incorporates by reference the entire contents of Japanese Patent Application No. 2010-055822 filed in Japan on Mar. 12, 2010.

BACKGROUND OF THE INVENTION

1. Field of the Invention

The present invention relates to a fixing device that fixes a toner image on a recording medium and also relates to an image forming apparatus including the fixing device. Examples of the image forming apparatus include a copying machine, a printer, a facsimile, and a multifunction peripheral (MFP) having these functions.

2. Description of the Related Art

In recent years, energy saving and speeding-up have been commercially required increasingly for an image forming apparatus such as a copying machine. In order to achieve these requirements, it is important to improve the thermal efficiency of a fixing device used in the image forming apparatus.

In the image forming apparatus, a non-fixed toner image is formed on a recording medium such as a recording material sheet, printing paper, photosensitive paper, or electrostatic recording paper in accordance with an image transfer system or a direct system by an image forming process of electrophotographic recording, electrostatic recording, magnetic recording or the like. Fixing devices of contact heating systems are widely employed as fixing devices for fixing a non-fixed toner image. Examples of the contact heating systems include a heat roller system, a film heating system, and an electromagnetic inductive heating system.

A fixing device of a heat roller system basically includes a pair of rotating rollers including a fixing roller and a pressing roller. The fixing roller has a heat source such as a halogen lamp therein, so that the temperature of the fixing roller is adjusted to a predetermined temperature. The pressing roller makes pressure-contact with the fixing roller. A recording medium is guided to a so-called fixing nip portion as a contact portion between the pair of the rotating rollers so as to be conveyed. Then, a non-fixed toner image is fused and fixed by heat and pressure from the fixing roller and the pressing roller.

A fixing device of a heat roller system having the following configuration is disclosed in Japanese Patent Application Laid-open No. 2008-065042. In this fixing device, even when a member of a separating section is configured to be detachably connected or depressurized in order to enhance usage life of a fixing rotating member, a tip of the separating member can be responded to fluctuation on a surface of the fixing rotating member on a nip portion.

Furthermore, a fixing device of a film heating system is disclosed in Japanese Patent Application Laid-open No. S63-313182 and Japanese Patent Application Laid-open No. H1-263679. The fixing device makes a recording medium close contact with a heating body that is fixedly supported by a supporting member through a thin fixing film having heat resistance, so that heat of the heating body is supplied to the recording medium through the film material while the fixing film is slidingly moved on the heating body. In the fixing device, a ceramic heater including a resistance layer on a ceramic substrate such as alumina, or aluminum nitride is used as the heating body, for example. Such ceramic substrate has properties of heat resistance, insulation property, excellent heat conductivity, and the like. In the fixing device, a thin film having low heat capacity can be used as the fixing film. Therefore, the fixing device has higher heat transfer efficiency than that of the fixing device of the heat roller system. Accordingly, a warm-up time can be reduced and quick start and energy saving can be realized in the fixing device.

As a fixing device of an electromagnetic inductive heating system, the following fixing device is disclosed in Japanese Utility Model Laid-open No. S51-109739. In this fixing device, an eddy current is induced in a metal layer (heat generating layer) of a fixing sleeve with magnetic flux so as to generate heat with Joule heat thereof. With the fixing device, a fixing film itself produces heat by utilizing generation of induction current, so that a fixing process having higher efficiency than that in the fixing device of the heat roller system in which a halogen lamp is used as a heat source can be realized.

As a fixing device of an electromagnetic inductive heating system, the following configuration has been well known. The fixing device includes a fixing sleeve having a release layer, an elastic layer, a metal layer (heat generating layer), and a fixing roller that is formed by the elastic layer included in the fixing sleeve and a supporting body (core). Furthermore, in the fixing device, the fixing roller and a pressing roller are made pressure-contact with each other through the fixing sleeve so as to form a pressure-contact nip portion.

In the configuration, the fixing sleeve is prevented from moving (displacing) in the thrust direction by adhering the fixing sleeve and the fixing roller to each other with a silicone adhesive or the like. Alternatively, the fixing sleeve is prevented from moving (advancing) in the thrust direction by arranging a ring having a diameter larger than that of the fixing sleeve on an end of the fixing roller when the fixing sleeve and the fixing roller are not adhered to each other.

A recording medium onto which a toner image has been fixed on the fixing nip portion formed by the fixing roller and the pressing roller is discharged in the direction of winding up around the fixing roller or the pressing roller depending on viscosity of toner that is molten and not cooled or the orientation of the fixing nip portion. Therefore, a separating member has been conventionally used for guiding the recording medium to a right conveying path. A contact type claw has been used as the separating member in the past. However, contact marks of the claw marked on the roller appear on a full-color image. In order to eliminate the problem, a non-contact type separating plate is widely used in recent years. With the non-contact type separating plate, it is important to adjust a separation gap between the separating plate and the roller. Therefore, a steel metal plate is typically used as the non-contact type separating plate in order to achieve a required positional accuracy. Furthermore, such steel metal plate has not a claw-like shape but a plate-like shape so as not to cause image deterioration due to scratching onto the recording medium.

As described above, in order to achieve energy saving, the recent fixing device is required to be made into a stand-by state as fast as possible by rapidly heating the fixing device after an apparatus has been powered ON. Therefore, a configuration in which heat supplied to the pressing roller is suppressed to the minimum in order to heat the fixing roller much faster at the time of preparing for the stand-by state (rising) is employed. However, with such configuration, a difference in temperatures between the fixing roller and the pressing roller immediately after the rising is large. Accordingly, a recording medium immediately after passing through the fixing nip portion is largely back-curled to the pressing roller side due to the difference in temperatures between the front and back surfaces thereof.

In addition, in order to lower the heat amount of the pressing roller for speeding up the rising, an elastic layer on a surface of the pressing roller is required to be made as thin as possible. If the elastic layer on the surface of the pressing roller is made thinner, the pressing roller bites into the fixing roller so that an exit of the fixing nip portion directs to the pressing roller side. This causes a problem that a recording medium is easily wound up around the pressing roller.

Furthermore, when backing paper is used as a recording medium or duplex printing is performed, the following problem occurs. When a large amount of toner has been already adhered to a non-image surface of the recording medium, the recording medium is easily wound up around the pressing roller due to strong adhesive force between the non-image surface of the recording medium and the pressing roller.

Conventionally, in order to separate and convey a recording medium that is easily wound up around the fixing roller due to viscosity of toner, a separating mechanism is arranged on an image surface side and only a conveyance guide made of resin is arranged on a non-image surface side in a supporting manner in normal cases. However, for the reasons described above, in order to separate and convey the recording medium that is wound up around the pressing roller, a separating member having high positional accuracy is also required to be arranged on the non-image surface side. In this case, a non-contact type separating member is needed to be used not only on the image surface side but also on the non-image surface side for ensuring required image quality. Therefore, a separating plate is needed to be used on both the image surface side and the non-image surface side.

Conventionally, when jam of a recording medium occurs in a fixing device, a conveyance guide is configured so as to be opened or closed by a user or a service person for removing paper left on a fixing nip portion. However, when a separating plate is used on both the image surface side and the non-image surface side, a distance between both of the separating plates is normally narrow. Therefore, it is still difficult to make one's finger reach the fixing nip portion on a rear side of the separating plates even when the conveyance guide is opened. Furthermore, since the separating plates formed by a steel metal plate become high temperature exceedingly, it is dangerous for the user or the service person to touch the separating plates.

SUMMARY OF THE INVENTION

It is an object of the present invention to at least partially solve the problems in the conventional technology.

According to an aspect of the present invention, there is provided a fixing device that includes a fixing member that heats a toner image on a recording medium, fixes the toner image onto the recording medium, and conveys the recording medium; a heating member that heats the fixing member; a pressing member that presses the fixing member to form a fixing nip portion; a separating member on the image surface side that is arranged downstream of the fixing member in a conveyance direction and separates the recording medium from the fixing member; a conveyance guiding member on the image surface side that is arranged downstream of the separating member on the image surface side in the conveyance direction; a separating member on the non-image surface side that is arranged downstream of the pressing member in the conveyance direction and separates the recording medium from the pressing member; and a conveyance guiding member on the non-image surface side that is arranged downstream of the separating member on the non-image surface side in the conveyance direction. The separating member on the image surface side is arranged so as not to make contact with an image range of the fixing member in the main-scanning direction, and when the conveyance guiding member on the image surface side is rotated about an axis of rotation thereof so as to be opened or closed, the separating member on the image surface side is also rotated or slid so as to be opened or closed simultaneously. The separating member on the non-image surface side is arranged so as not to make contact with an image range of the pressing member in the main-scanning direction, and when the conveyance guiding member on the non-image surface side is rotated about an axis of rotation thereof so as to be opened or closed, the separating member on the non-image surface side is also rotated or slid so as to be opened or closed simultaneously.

According to another aspect of the present invention, there is provided an image forming apparatus that includes an image forming unit that forms a toner image onto a recording medium; and a fixing device. The fixing device includes a fixing member that heats the toner image on the recording medium, fixes the toner image onto the recording medium, and conveys the recording medium; a heating member that heats the fixing member; a pressing member that presses the fixing member to form a fixing nip portion; a separating member on the image surface side that is arranged downstream of the fixing member in a conveyance direction and separates the recording medium from the fixing member; a conveyance guiding member on the image surface side that is arranged downstream of the separating member on the image surface side in the conveyance direction; a separating member on the non-image surface side that is arranged downstream of the pressing member in the conveyance direction and separates the recording medium from the pressing member; and a conveyance guiding member on the non-image surface side that is arranged downstream of the separating member on the non-image surface side in the conveyance direction. The separating member on the image surface side is arranged so as not to make contact with an image range of the fixing member in the main-scanning direction, and when the conveyance guiding member on the image surface side is rotated about an axis of rotation thereof so as to be opened or closed, the separating member on the image surface side is also rotated or slid so as to be opened or closed simultaneously. The separating member on the non-image surface side is arranged so as not to make contact with an image range of the pressing member in the main-scanning direction, and when the conveyance guiding member on the non-image surface side is rotated about an axis of rotation thereof so as to be opened or closed, the separating member on the non-image surface side is also rotated or slid so as to be opened or closed simultaneously.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 6 is a schematic cross-sectional view illustrating a wire interlocking mechanism for interlocking opening/closing of the separating plate with opening/closing of the conveyance guide using a wire, a tensioner and the like;

FIG. 7 is a schematic cross-sectional view illustrating a gear interlocking mechanism for interlocking opening/closing of the separating plate with opening/closing of the conveyance guide using an idler gear and the like; and FIG. 8 is a schematic cross-sectional view illustrating a link interlocking mechanism for interlocking opening/closing of the separating plate with opening/closing of the conveyance guide using a link mechanism formed by a link arm and the like.

DETAILED DESCRIPTION OF THE PREFERRED EMBODIMENTS

Hereinafter, embodiments of the present invention are described with reference to the accompanying drawings.

Figure 1:
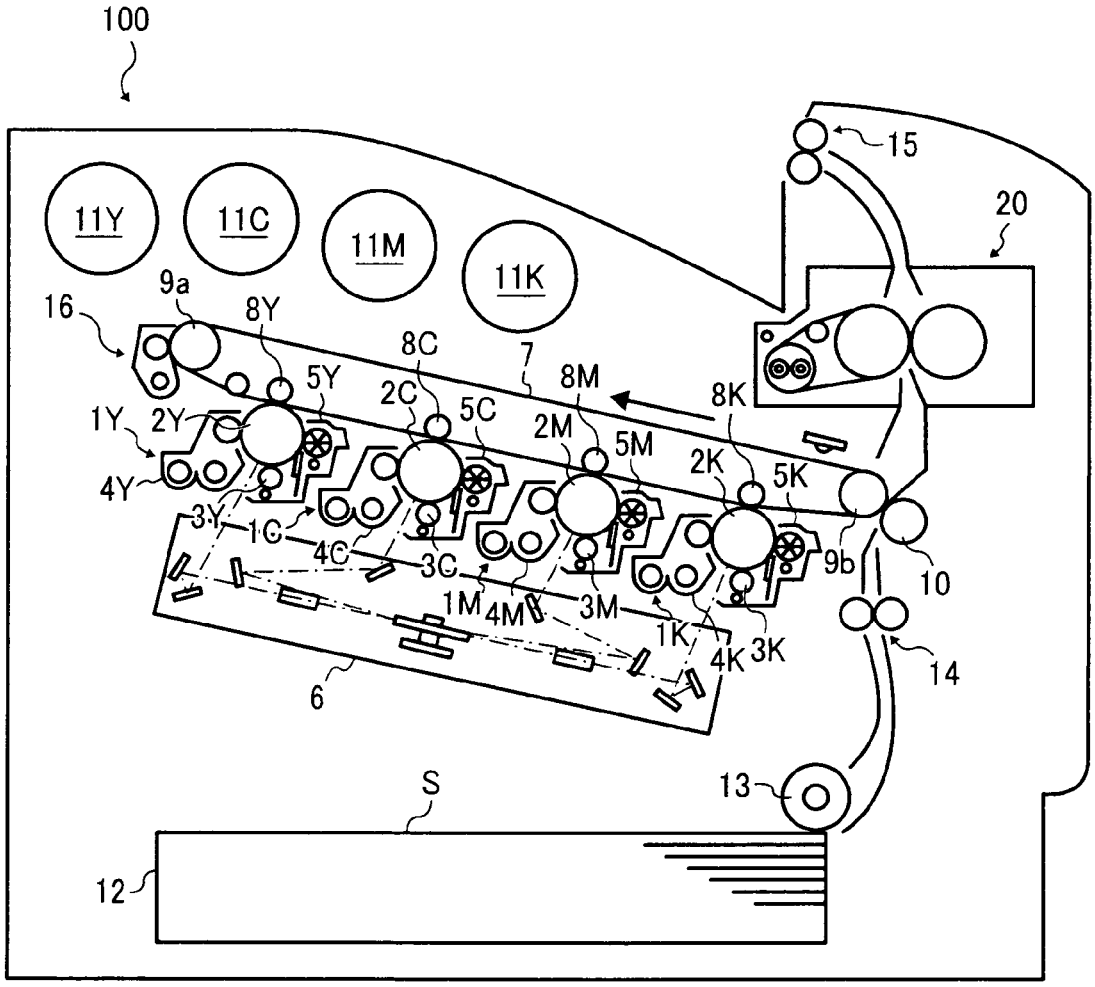
FIG. 1 is a schematic cross-sectional view illustrating an example of an image forming apparatus such as a color printer on which a fixing device according to the present invention is provided.

FIG. 1 is a schematic cross-sectional view illustrating an example of an image forming apparatus 100 such as a color printer on which a fixing device according to the present invention is provided. A plurality of (four in the example illustrated in FIG. 1) image forming units 1Y, 1C, 1M, 1K are provided on an image forming section. The first through fourth image forming units 1Y, 1C, 1M, and 1K have the same configuration but only toner colors corresponding to the first through fourth image forming units 1Y, 1C, 1M, and 1K are different from each other. For example, a yellow toner image, a cyan toner image, a magenta toner image, and a black toner image are formed on these image forming units, respectively. It is to be noted that because these image forming units have the same configuration other than the difference in colors of developer (toner), Y, C, M, and K added to reference numerals are appropriately omitted in the following description.

Drum-like photosensitive elements 2Y, 2C, 2M, and 2K as electrostatic latent image carriers are arranged on the image forming units 1Y, 1C, 1M, and 1K, respectively. Charging members 3Y, 3C, 3M, and 3K, developing units 4Y, 4C, 4M, and 4K, and cleaning devices 5Y, 5C, 5M, and 5K are provided around the photosensitive elements 2Y, 2C, 2M, and 2K, respectively. Each of the photosensitive elements 2Y, 2C, 2M, and 2K rotationally drives in the clockwise direction. Each of the charging member 3Y, 3C, 3M, and 3K is made pressure-contact with a surface of each of the photosensitive elements 2Y, 2C, 2M, and 2K so as to be dependent-rotated with the rotational driving of each of the photosensitive elements 2Y, 2C, 2M, and 2K. Furthermore, a predetermined bias voltage is applied to each of the charging member 3Y, 3C, 3M, and 3K by a high-voltage power supply (not illustrated), so that each of the charging member 3Y, 3C, 3M, and 3K can uniformly charge the surface of each of the photosensitive elements 2Y, 2C, 2M, and 2K that rotationally drives. It is to be noted that although a roller-form member that makes contact with each of the photosensitive element 2Y, 2C, 2M, and 2K is employed as each of the charging member 3Y, 3C, 3M, and 3K illustrated in FIG. 1, a non-contact type member utilizing corona discharge or the like can be also employed as each of the charging member 3Y, 3C, 3M, and 3K.

Furthermore, an exposure unit 6 is provided on an oblique lower side of the four image forming units 1Y, 10, 1M, and 1K so as to be in parallel with the image forming units 1Y, 10, 1M, and 1K. The exposure unit 6 has appropriate constituent members such as a light source, a polygon mirror, an f-θ lens, and a reflection mirror. The exposure unit 6 exposes the photosensitive elements 2Y, 2C, 2M, and 2K charged by the charging members 3Y, 3C, 3M, and 3K based on image information formed in accordance with image data of each color of toner so as to form electrostatic latent images on the photosensitive elements 2Y, 2C, 2M, and 2K. Each color of toner is added to each of the electrostatic latent images formed on the photosensitive elements 2Y, 2C, 2M, and 2K by using the exposure unit 6 when the electrostatic latent images pass through the developing units 4Y, 4C, 4M, and 4K with the rotation of the photosensitive elements 2Y, 2C, 2M, and 2K. With this, the electrostatic latent images are developed and visualized. Toner bottles 11Y, 11C, 11M, 11K are arranged on upper portions in the image forming apparatus. Toners of each color of yellow, cyan, magenta, and black are filled into the toner bottles 11Y, 11C, 11M, 11K, respectively. A predetermined replenishing amount of toner is replenished from each of the toner bottles 11Y, 11C, 11M, 11K to each of the developing units 4Y, 4C, 4M, 4K through conveying paths (not illustrated).

Furthermore, an endless intermediate transfer belt 7 configured as an intermediate transfer member is arranged so as to be opposed to the photosensitive elements 2Y, 2C, 2M, and 2K of the image forming units. Each of the photosensitive elements 2Y, 2C, 2M, and 2K abuts against a surface of the intermediate transfer belt 7. The intermediate transfer belt 7 illustrated in FIG. 1 is configured so as to be wound around a plurality of supporting rollers (for example, supporting rollers 9*a*, 9*b* and the like). In the example illustrated in FIG. 1, the supporting roller 9*a* is coupled to a driving motor as a driving source (not illustrated). If the driving motor is driven, the intermediate transfer belt 7 rotationally moves in the counterclockwise direction in FIG. 1. Then, the supporting roller 9*b* that is dependent-rotatable also rotates with the rotational movement of the intermediate transfer belt 7. Furthermore, primary transfer rollers 8Y, 8C, 8M, and 8K are arranged on an inner side of the intermediate transfer belt 7 at positions opposed to the photosensitive elements 2Y, 2C, 2M, and 2K across the intermediate transfer belt 7. A primary transfer bias is applied to each primary transfer roller 8Y, 8C, 8M, and 8K from a high-voltage power supply (not illustrated), so that the toner image visualized by each of the developing units 4Y, 4C, 4M, and 4K is primarily transferred onto the intermediate transfer belt 7. It is to be noted that primary transfer residual toners that have not been primarily transferred and are left on the photosensitive elements 2Y, 2C, 2M, and 2K are removed by the cleaning devices 5Y, 5C, 5M, and 5K for preparing a subsequent image forming operation with the photosensitive elements 2Y, 2C, 2M, and 2K, and toners on the photosensitive elements 2Y, 2C, 2M, and 2K are completely removed.

Furthermore, a secondary transfer roller 10 as a secondary transfer device is provided downstream in the driving direction of the intermediate transfer belt 7. The secondary transfer roller 10 is opposed to the supporting roller 9*b* across the intermediate transfer belt 7. The secondary transfer roller 10 and the supporting roller 9*b* form a secondary transfer nip portion through the intermediate transfer belt 7. The image forming apparatus includes a paper cassette 12 as a stacking section of a recording medium S, a feeding roller 13, a pair of resist rollers 14, and the like. Furthermore, in the image forming apparatus, a fixing device 20 and a pair of ejecting rollers 15 are provided downstream of the secondary transfer roller 10 in the conveyance direction of a recording medium S.

Next, an image forming operation is described.

At first, the photosensitive elements 2Y, 2C, 2M, and 2K are rotationally driven in the clockwise direction by a driving source (not illustrated). At this time, surfaces of the photosensitive elements 2Y, 2C, 2M, and 2K are irradiated with light from a neutralization apparatus (not illustrated), so that surface potentials thereof are initialized. Next, the surfaces of the photosensitive elements 2Y, 2C, 2M, and 2K are uniformly charged to a predetermined polarity by the charging members 3Y, 3C, 3M, and 3K. Next, the surfaces of the photosensitive elements 2Y, 2C, 2M, and 2K are irradiated with laser beam from the exposure unit 6. With the exposure, electrostatic latent images are formed on the surfaces of the photosensitive elements 2Y, 2C, 2M, and 2K. At this time, image information exposed to each of the photosensitive elements 2Y, 2C, 2M, and 2K is image information of single color obtained by exploding a desired full-color image into information of each toner color of yellow, cyan, magenta, and black. Then, each color of toner (developer) is added to each of the electrostatic latent images formed on the photosensitive elements 2Y, 2C, 2M, and 2K from the developing units 4Y, 4C, 4M, and 4K when the electrostatic latent images pass through the developing units 4Y, 4C, 4M, and 4K. With this, the images become visible as visualized toner images.

Furthermore, the intermediate transfer belt 7 is driven to travel in the counterclockwise direction in FIG. 1. On the other hand, a primary transfer voltage having a polarity opposite to a toner charged polarity of toner images formed on the photosensitive elements 2Y, 2C, 2M, and 2K is applied to each of the primary transfer rollers 8Y, 8C, 8M, and 8K. Therefore, transfer electric fields are formed between the photosensitive elements 2Y, 2C, 2M, and 2K and the intermediate transfer belt 7. Then, the toner images on the photosensitive elements 2Y, 2C, 2M, and 2K are primarily transferred electrostatically onto the intermediate transfer belt 7 that is rotationally driven in synchronization with the photosensitive elements 2Y, 2C, 2M, and 2K. The toner images of each color that are primarily transferred in such a manner are sequentially superimposed on the intermediate transfer belt 7 from the upstream side in the conveyance direction of the intermediate transfer belt 7 at appropriate timings. With this, a desired full-color image is formed.

A recording medium S on which an image is to be formed is separated one by one from a stack of recording media stacked on the paper cassette 12 so as to be fed to the pair of resist rollers 14 by conveyance members such as the feeding roller 13. At this time, the leading edge of the conveyed recording medium S abuts against a nip portion between the pair of resist rollers 14 that are not started to be rotationally driven so as to form a loop. Then, registration of the recording medium S is performed. Thereafter, the pair of resist rollers 14 are started to be rotationally driven at an appropriate timing in consideration of a timing at which the full-color toner image carried on the intermediate transfer belt 7 is conveyed. Then, the recording medium S is fed to the secondary transfer nip portion formed by the supporting roller 9*b* and the secondary transfer roller 10. In the embodiment, a transfer voltage having a polarity opposite to a toner charged polarity of the toner image on the surface of the intermediate transfer belt 7 is applied to the secondary transfer roller 10. With this, the full-color toner image formed on the surface of the intermediate transfer belt 7 is collectively transferred onto the recording medium S. Subsequently, the recording medium S onto which the toner image has been transferred is conveyed to the fixing device 20. When the recording medium S passes through the fixing device 20, heat and pressure are applied thereto, so that the toner image is fixed onto the recording medium S as a permanent image. Then, the recording medium S is discharged to a recording medium discharging section such as a discharge tray through the pair of ejecting rollers 15, and the image forming operation is completed. It is to be noted that the residual toner that has not been transferred on the secondary transfer nip portion and is left on the intermediate transfer belt 7 is removed and collected by an intermediate transfer belt cleaning unit 16.

Figure 2:
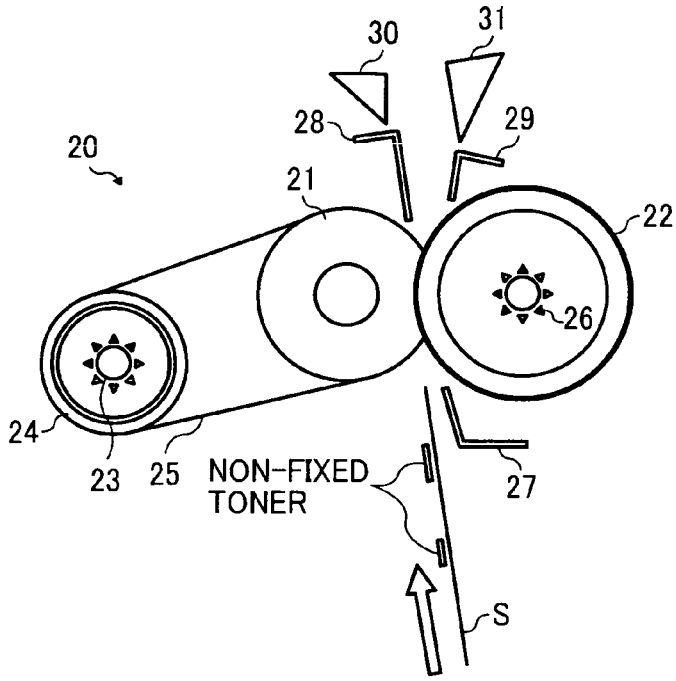
FIG. 2 is a schematic cross-sectional view illustrating a fixing device according to an embodiment of the present invention.

FIG. 2 is a schematic cross-sectional view illustrating a fixing device according to an embodiment of the present invention.

The fixing device 20 includes a fixing belt 25 as a fixing member, a fixing roller 21 and a heating roller 24 around which the fixing belt 25 is wound, a pressing roller 22 as a pressing member that is opposed to and makes pressure-contact with the fixing roller 21 through the fixing belt 25, and the like. The pressing roller 22 makes pressure-contact with the fixing roller 21 through the fixing belt 25, so that a fixing nip portion is formed by the fixing belt 25 and the pressing roller 22. As illustrated in FIG. 2, a recording medium S onto which a toner image has been secondarily transferred from the intermediate transfer belt 7 is guided by an entrance guide 27 and conveyed to the fixing nip portion. At this time, the recording medium S is guided and conveyed while an image surface side on which a toner image to be fixed is formed faces the fixing roller side. When the recording medium S is conveyed while being nipped on the fixing nip portion, pressing force from the pressing roller 22 and heat of the fixing belt 25 are applied to the recording medium S, so that the toner image is fixed onto the recording medium S. Note that the fixing belt 25 is heated with heat transferred from the heating roller 24 that has been heated with a heating action of a heater 23. The recording medium S onto which the toner image has been fixed is separated from the fixing roller 21 by a separating plate 28 on the image surface side and a separating plate 29 on the non-image surface side. The separating plate 28 and the separating plate 29 are non-contact type separating units. Then, the recording medium S is guided between a conveyance guide 30 on the image surface side and a conveyance guide 31 on the non-image surface side so as to be discharged onto the discharge tray with the rotation of the pair of ejecting rollers 15. Note that the conveyance guide 30 and the conveyance guide 31 form a conveying path of the recording medium S.

Cross sections of these separating plates 28 and 29 have an L shape as illustrated in FIG. 2. Furthermore, tips of these separating plates 28 and 29 are formed to be sharp so as to easily catch the leading edge of a recording medium. Furthermore, the separating plates 28 and 29 are extended in the direction (main-scanning direction) perpendicular to a paper plane along shafts of the fixing roller and the pressing roller, respectively. The separating plates 28 and 29 are arranged so as not to make contact with image ranges of the fixing roller and the pressing roller in the main-scanning direction. It is to be noted that shapes of the conveyance guide and a link arm are schematically illustrated.

A fixing device having the separating plate 28 on the image surface side, the conveyance guide 30 on the image surface side, and the conveyance guide 31 on the non-image surface side has been conventionally known. However, in the present invention, the separating plate 29 on the non-image surface side is further provided in addition to the above components for the following reason. Conventionally, when backing paper is used as a recording medium or duplex printing is performed, the following problem occurs. When a large amount of toner has been already adhered to a non-image surface of the recording medium, the recording medium S is easily wound up around the pressing roller 22 due to strong adhesive force between the non-image surface of the recording medium S and the pressing roller 22 so as to cause jam. In order to prevent such jam from occurring, the separating plate 29 on the non-image surface side is provided.

In addition, a heater 23 as a heating unit is incorporated in the heating roller 24, and a heater 26 as a heating unit is incorporated in the pressing roller 22. The heater 26 is provided in the pressing roller 22 so as not to cause a problem in that when the temperature of the pressing roller 22 is lower than that of the fixing roller 21 at the time of rising of the apparatus or the like, fixing failure occurs because the pressing roller 22 draws heat from the fixing roller 21.

The fixing belt 25 has resistance to heat, and an elastic layer for responding to irregularities of a recording medium S is formed on the surface of the fixing belt 25. As a typical configuration of the fixing belt 25, a configuration in which a silicone rubber having a thickness of 200 μm as the elastic layer, and a PFA layer (tetrafluoroethylene-perfluoroalkyl vinyl ether copolymer film) having a thickness of 10 μm are stacked on polyimide resin having a thickness of 80 μm as a base material is exemplified. It is to be noted that when a material having excellent releasability to toner, paper powder, or the like can be employed as the elastic layer, the PFA layer as a surface can be eliminated.

In order to form a fixing nip portion on which an appropriate surface pressure and a nip width can be applied to a recording medium S to be nipped and conveyed, the fixing roller 21 and the pressing roller 22 are generally configured by using an elastic material such as a rubber or a foam such as a sponge. In the embodiment, a sponge roller having a hardness of approximately 35 Hs is employed for the fixing roller 21, and a rubber having a thickness of approximately 3 mm and a hardness of approximately 60 Hs is employed for the surface of the pressing roller 22.

As will be described later, when the recording medium S is jammed on the fixing nip portion, the narrow fixing nip portion is largely opened in the following manner. If a housing cover (not illustrated) of the fixing device on the image surface side is rotationally moved in the counterclockwise direction so as to be opened, the separating plate 28 on the image surface side and the conveyance guide 30 on the image surface side are rotationally moved or slid simultaneously. Note that the housing cover on the image surface side is arranged on an upper side of the conveyance guide 30 on the image surface side. Furthermore, when a housing cover (not illustrated) of the fixing device on the non-image surface side is rotationally moved in the clockwise direction so as to be opened, the separating plate 29 on the non-image surface side and the conveyance guide 31 on the non-image surface side are rotationally moved or slid simultaneously. Note that the housing cover on the non-image surface side is arranged on an upper side of the conveyance guide 31 on the non-image surface side. With this, the narrow fixing nip portion is largely opened. Accordingly, a user accesses to the fixing nip portion, so that the jammed recording medium S can be removed reliably and immediately.

Figure 3:
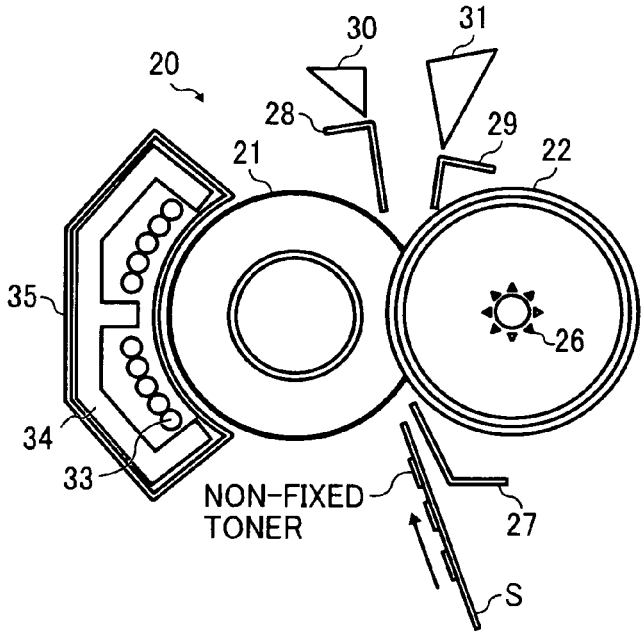
FIG. 3 is a schematic cross-sectional view illustrating a fixing device according to another embodiment of the present invention.

FIG. 3 is a schematic cross-sectional view illustrating a fixing device according to another embodiment of the present invention.

The fixing device 20 is of an electromagnetic inductive heating system. A core 34, a coil 33 arranged in the core, a coil guide 35 that is opposed to the fixing roller 21 and holds the coil 33, and the like are provided on the fixing device 20 in place of the heater 23, the heating roller 24, and the fixing belt 25 in the embodiment illustrated in FIG. 2. The coil 33 as an exciting coil, the core 34 as an exciting coil core, and the coil guide 35 form an inductive heating unit. The coil 33 is obtained by winding a litz wire formed by bundling thin wires on the coil guide and extends in the width direction (direction perpendicular to a paper plane in FIG. 3). The coil guide is arranged so as to cover a part of an outer circumferential surface of the fixing roller 21.

The coil guide 35 is made of a resin material having excellent heat resistance such as PET (polyethylene terephthalate) containing approximately 45% of a glass material. The coil guide 35 is opposed to the outer circumferential surface of the fixing roller 21 and holds the coil 33. In the embodiment, the gap between the opposing surface of the coil guide 35 of the inductive heating unit and the outer circumferential surface of the fixing roller 21 is set to be 2±0.1 mm.

The core 34 is made of a ferromagnetic material such as ferrite having a relative magnetic permeability of approximately 2500. The core 34 is a member for forming efficient magnetic flux toward a heat generating layer in a sleeve layer as a surface layer of the fixing roller 21 and formed by an arch core, a center core, a side core, or the like.

The fixing device 20 configured in the above manner operates as follows.

The fixing roller 21 is rotationally driven in the counterclockwise direction in FIG. 3 by a driving motor (not illustrated). The pressing roller 22 is rotated in the clockwise direction with the rotational driving of the fixing roller 21. The heat generating layer in the sleeve layer of the fixing roller 21 is heated by magnetic flux generated from the inductive heating unit at a position opposed to the inductive heating unit.

To be more specific, if a high-frequency alternating current of 10 kHz to 1 MHz (preferably, 20 kHz to 800 kHz) is supplied to the coil 33 from a power source (not illustrated), magnetic lines are formed toward the sleeve layer of the fixing roller 21 from the coil 33 so as to be alternately switched in the both directions. Note that the power source has an oscillation circuit and frequencies thereof can be varied. If the alternating magnetic field is formed in such a manner, an eddy current is generated on the heat generating layer of the sleeve layer. Then, Joule heat is generated with electric resistance thereof, so that the heat generating layer is inductively heated. Thus, the sleeve layer of the fixing roller 21 is heated by the induction heating of the heat generating layer thereof.

The separating plate 29 on the non-image surface side is also provided in the embodiment. As in the embodiment illustrated in FIG. 2, when a recording medium S is jammed on the fixing nip portion, the narrow fixing nip portion is largely opened in the following manner. If a housing cover (not illustrated) of the fixing device on the image surface side is rotationally moved so as to be opened, the separating plate 28 on the image surface side and the conveyance guide 30 on the image surface side rotationally move or slide simultaneously. Note that the housing cover on the image surface side is arranged on an upper side of the conveyance guide 30 on the image surface side. Furthermore, if a housing cover (not illustrated) of the fixing device on the non-image surface side is rotationally moved so as to be opened, the separating plate 29 on the non-image surface side and the conveyance guide 31 on the non-image surface side rotationally move or slide simultaneously. Note that the housing cover on the non-image surface side is arranged on an upper side of the conveyance guide 31 on the non-image surface side. With these operations, the narrow fixing nip portion is largely opened.

FIGS. 4 through 8 are schematic cross-sectional views illustrating separating plates according to embodiments of the present invention, which are characteristic portions of the present invention.

Figure 4:
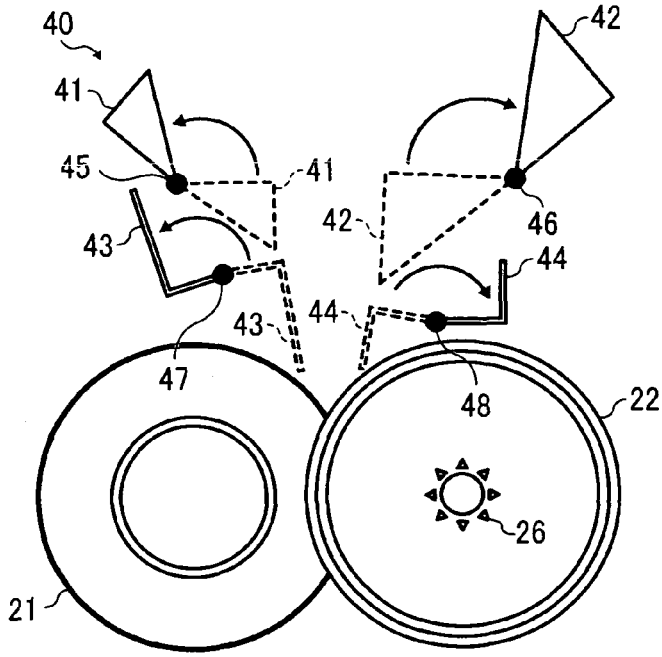
FIG. 4 is a schematic cross-sectional view illustrating separating plates according to an embodiment of the present invention and illustrating a state where a conveyance guide on the image surface side, a separating plate on the image surface side, a conveyance guide on the non-image surface side, and a separating plate on the non-image surface side are simultaneously rotated.

In the embodiment illustrated in FIG. 4, a conveyance guide 41 on the image surface side and a separating plate 43 on the image surface side rotationally move simultaneously so as to open and close with opening/closing of a housing cover of a fixing device 40 on the image surface side and the conveyance guide 41 on the image surface side. At this time, the conveyance guide 41 on the image surface side at a position when a recording medium passes as illustrated by a dashed line rotationally moves in the counterclockwise direction in FIG. 4 to a position for a jam elimination process as illustrated by a solid line. To be more specific, the conveyance guide 41 on the image surface side rotationally moves about a conveyance guide rotation axis 45 that is fixed to a fixing device side plate (not illustrated) or the like. With the rotational movement, the separating plate 43 on the image surface side at a position when a recording medium passes as illustrated by a dashed line also rotationally moves in the counterclockwise direction in FIG. 4 to a position for the jam elimination process as illustrated by a solid line. To be more specific, the separating plate 43 on the image surface side rotationally moves about a separating plate rotation axis 47 that is fixed to the fixing device side plate (not illustrated) or the like.

On the other hand, a conveyance guide 42 on the non-image surface side and a separating plate 44 on the non-image surface side rotationally move simultaneously so as to open and close with opening/closing of a housing cover of the fixing device 40 on the non-image surface side and the conveyance guide 42 on the non-image surface side. At this time, the conveyance guide 42 on the non-image surface side at a position when a recording medium passes as illustrated by a dashed line rotationally moves in the clockwise direction in FIG. 4 to a position for the jam elimination process as illustrated by a solid line. To be more specific, the conveyance guide 42 on the non-image surface side rotationally moves about a conveyance guide rotation axis 46 that is fixed to the fixing device side plate (not illustrated) or the like. With the rotational movement, the separating plate 44 on the non-image surface side at a position when a recording medium passes as illustrated by a dashed line also rotationally moves in the clockwise direction in FIG. 4 to a position for the jam elimination process as illustrated by a solid line. To be more specific, the separating plate 44 on the non-image surface side rotationally moves about a separating plate rotation axis 48 that is fixed to the fixing device side plate (not illustrated) or the like.

In such a manner, the conveyance guide 41 on the image surface side and the separating plate 43 on the image surface side rotationally move simultaneously, and the conveyance guide 42 on the non-image surface side and the separating plate 44 on the non-image surface side rotationally move simultaneously. Therefore, the narrow fixing nip portion is largely opened. Accordingly, even when the jam occurs on the narrow fixing nip portion, a user or a service person can remove a recording medium by opening the fixing nip portion. Furthermore, the jam elimination process can be safely performed without directly touching the separating plates 43 and 44 that are typically made of metal and become high temperature.

Figure 5:
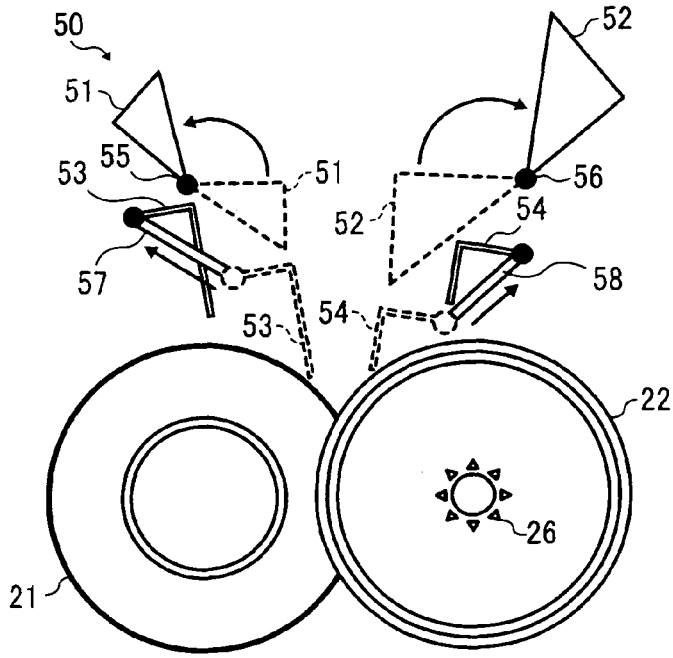
FIG. 5 is a schematic cross-sectional view illustrating separating plates according to an embodiment of the present invention and illustrating a state where a separating plate on the image surface side slides with rotation of a conveyance guide on the image surface side and a separating plate on the non-image surface side slides with rotation of a conveyance guide on the non-image surface side.

In the embodiment illustrated in FIG. 5, a separating plate 53 on the image surface side slides so as to open and close with opening/closing of a housing cover of a fixing device 50 on the image surface side and a conveyance guide 51 on the image surface side. At this time, the conveyance guide 51 on the image surface side at a position when a recording medium passes as illustrated by a dashed line rotationally moves in the counterclockwise direction in FIG. 5 to a position for the jam elimination process as illustrated by a solid line. To be more specific, the conveyance guide 51 rotationally moves about a conveyance guide rotation axis 55 that is fixed to a fixing device side plate (not illustrated) or the like. With the rotational movement, the separating plate 53 on the image surface side at a position when a recording medium passes as illustrated by a dashed line slidingly moves to a position for the jam elimination process as illustrated by a solid line. To be more specific, the separating plate 53 on the image surface side slidingly moves along a separating plate slide rail 57 that is fixed to the fixing device side plate (not illustrated) or the like.

On the other hand, a separating plate 54 on the non-image surface side slides so as to open and close with opening/closing of a housing cover of the fixing device 50 on the non-image surface side and a conveyance guide 52 on the non-image surface side. At this time, the conveyance guide 52 on the non-image surface side at a position when a recording medium passes as illustrated by a dashed line rotationally moves in the clockwise direction in FIG. 5 to a position for the jam elimination process as illustrated by a solid line. To be more specific, the conveyance guide 52 rotationally moves about a conveyance guide rotation axis 56 that is fixed to the fixing device side plate (not illustrated) or the like. With the rotational movement, the separating plate 54 on the non-image surface side at a position when a recording medium passes as illustrated by a dashed line slidingly moves to a position for the jam elimination process as illustrated by a solid line. To be more specific, the separating plate 54 on the non-image surface side slidingly moves along a separating plate slide rail 58 that is fixed to the fixing device side plate (not illustrated) or the like.

In such a manner, the separating plate 53 on the image surface side slidingly moves with the rotational movement of the conveyance guide 51 on the image surface side, and the separating plate 54 on the non-image surface side slidingly moves with the rotational movement of the conveyance guide 52 on the non-image surface side. Therefore, the narrow fixing nip portion is largely opened. If the separating plates 53 and 54 open and close while sliding as described above, tips of the separating plates 53 and 54 that typically have sharp shapes do not face a user unlikely in the case where the separating plates open and close while rotating. Accordingly, the jam elimination process can be performed more safely.

Figure 6:
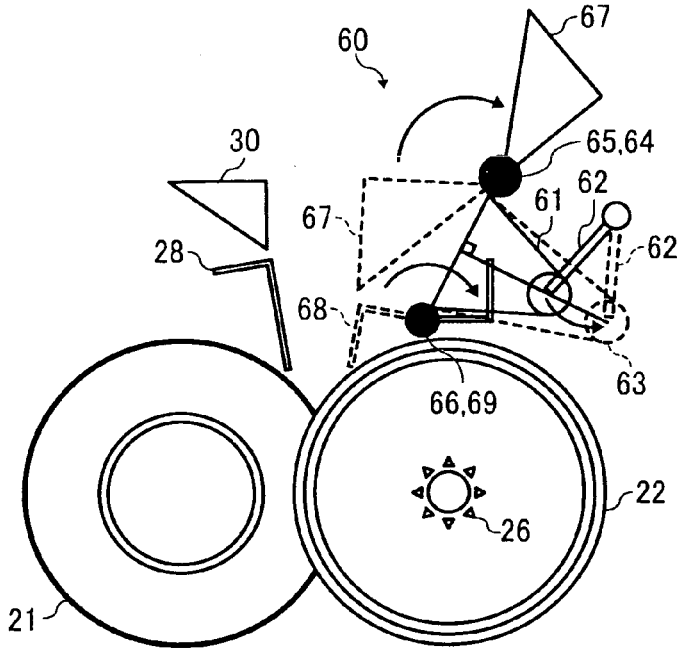
Figure 7:
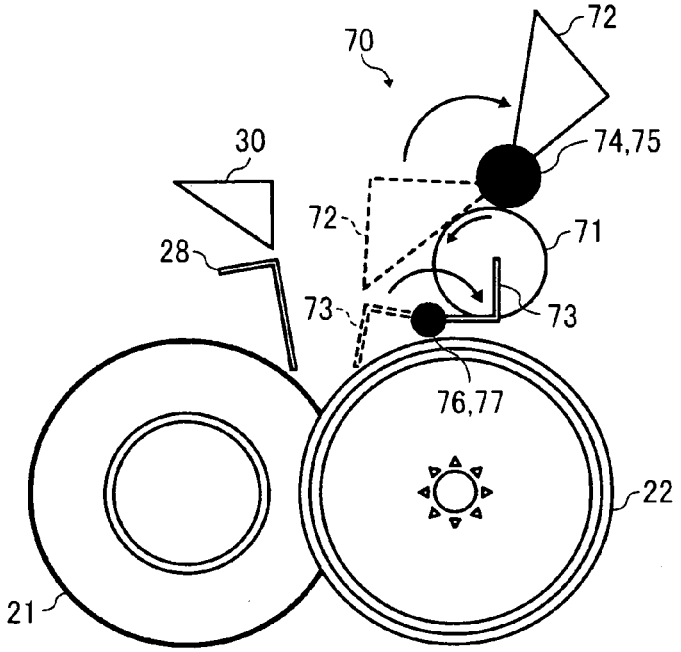
Figure 8:
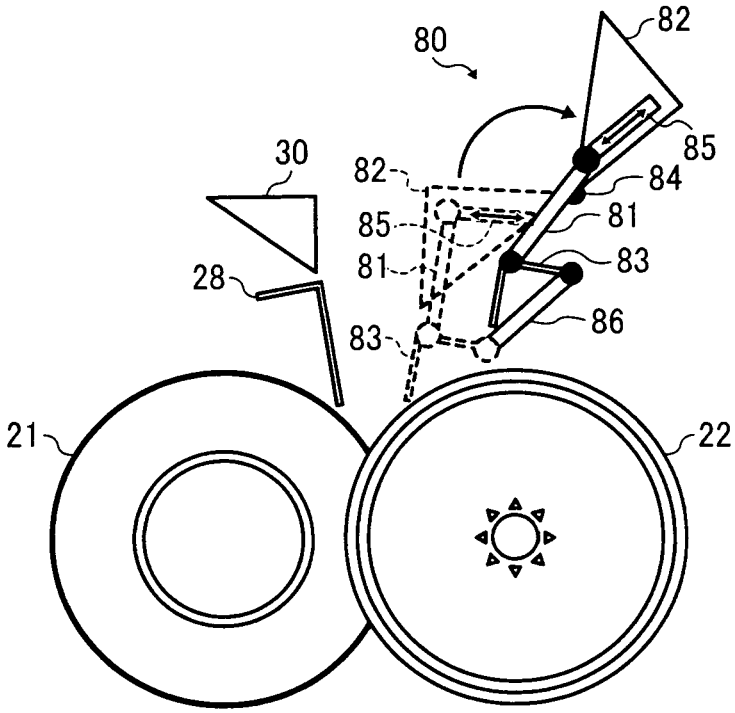

FIGS. 6 through 8 are schematic cross-sectional views illustrating specific interlocking mechanisms for interlocking opening/closing of the separating plate with opening/closing of the conveyance guide.

FIG. 6 illustrates a wire interlocking mechanism 60 in which a separating plate 68 opens and closes with opening/ closing of a conveyance guide 67 using a wire 61, a tensioner 62 such as a spring, a relay drum 63, a wire rolling-up drum 64, and the like. At a position when a recording medium passes as illustrated by a dashed line, an end of the wire 61 is connected to a driven drum 69 through the relay drum 63 held by the tensioner 62 with a play. The other end of the wire 61 is connected to the wire rolling-up drum 64. If the conveyance guide 67 rotates about a conveyance guide rotation axis 65 so as to open, the wire 61 is rolled up by the wire rolling-up drum 64 that is arranged on the same axis as that of the conveyance guide rotation axis 65. With this, the tensioner 62 and the relay drum 63 move to positions as illustrated by solid lines from positions illustrated by dashed lines in FIG. 6 by an amount of the play, and the tensioner 62 stops at the position illustrated by the solid line in FIG. 6 by a stopper (not illustrated). Then, when the conveyance guide 67 is further rotated, one end of the wire 61 is further rolled up by the wire rolling-up drum 64. In this case, the other end of the wire 61 makes the driven drum 69 that is arranged on the same axis as that of a separating plate rotation axis 66 rotationally move by an amount that the wire 61 is rolled up. Accordingly, the separating plate 68 also rotates to a position for the jam elimination process as illustrated by a solid line from a position when a recording medium passes as illustrated by a dashed line so as to open.

In order to obtain constant tensile force by the wire 61 all the time, the tensioner 62 is arranged such that the relay drum 63 is movable in a range close to a normal line passing through a center point of a segment obtained by connecting an axis of the wire rolling-up drum 64 and an axis of the driven drum 69. By using the tensioner 62 and the relay drum 63 in such a manner, the wire 61 can have a play. Furthermore, the position of the separating plate 68 when a recording medium passes can be determined with respect to the pressing roller with high accuracy not by tensile force of the wire 61 but by abutting against the end of the pressing roller, for example. It is to be noted that the wire rolling-up drum 64 is formed as a rolling-up part so as to roll up the wire or the like.

In the embodiment illustrated in FIG. 6, the wire interlocking mechanism 60 is arranged on the non-image surface side. However, the wire interlocking mechanism(s) 60 may be arranged on the image surface side or on both of the sides and interlock the conveyance guide(s) and the separating plate(s) on the image surface side or on both of the sides with each other.

It is to be noted that any one or both of the conveyance guide 67 and the separating plate 68 may slidingly operate so as to open and close as long as the wire 61 is used.

By using the wire 61 in such a manner, the conveyance guide 67 and the separating plate 68 are interlocked with each other reliably. Furthermore, a space-saved design can be made. In addition, the wire 61 whose operation length is hard to be adjusted can be used by using the tensioner 62.

FIG. 7 illustrates a gear interlocking mechanism 70 in which a separating plate 73 opens and closes with opening/closing of a conveyance guide 72 by using an idler gear 71 and the like. If the conveyance guide 72 rotates in the clockwise direction to a position for the jam elimination process as illustrated by a solid line from a position when a recording medium passes as illustrated by a dashed line in FIG. 7 so as to open, a driving gear 75 that is arranged on the same axis as that of a conveyance guide rotation axis 74 also rotates in the clockwise direction. The driving gear 75 engages with the idler gear 71 held by a fixing device side plate (not illustrated) or the like. Furthermore, the idler gear 71 engages with a driven gear 77 that is arranged on the same axis as that of a separating plate rotation axis 76. Therefore, the driven gear 77 also rotates in the clockwise direction through the idler gear 71 with the rotation of the driving gear 75 in the clockwise direction. Accordingly, the separating plate 73 also rotates in the clockwise direction to a position for the jam elimination process as illustrated by a solid line from a position when a recording medium passes as illustrated by a dashed line in FIG. 7.

When the separating plate 73 is at the position when a recording medium passes, teeth of the idler gear 71 in the vicinity of a position where the idler gear 71 engages with the driven gear 77 of the separating plate 73 are eliminated. With this, the separating plate 73 can be positioned with respect to the pressing roller at high accuracy not by the engagement of gears but by abutting against the end of the pressing roller, for example.

In the embodiment illustrated in FIG. 7, the gear interlocking mechanism 70 is arranged on the non-image surface side. However, the gear interlocking mechanism(s) 70 may be arranged on the image surface side or on both of the sides and interlock the conveyance guide(s) and the separating plate(s) on the image surface side or on both of the sides with each other. Furthermore, any one or both of the conveyance guide 72 and the separating plate 73 may slidingly operate so as to open and close as long as the gears are used.

By using the idler gear 71, the driving gear 75, and the driven gear 77 in such a manner, the conveyance guide 72 and the separating plate 73 are interlocked with each other reliably. Furthermore, the opening/closing degree of the separating plate 73 can be matched with the opening/closing degree of the conveyance guide 72 reliably. In addition, inexpensive gears can be used and the number of parts can be reduced.

FIG. 8 illustrates a link interlocking mechanism 80 in which a separating plate 83 opens and closes with opening/closing of a conveyance guide 82 by using a link mechanism formed by a link arm 81 and the like. If the conveyance guide 82 rotates in the clockwise direction about a conveyance guide rotation axis 84 to a position for the jam elimination process as illustrated by a solid line from a position where a recording medium passes as illustrated by a dashed line in FIG. 8 so as to open, one end of the link arm 81 coupled to a link arm slide rail 85 on the conveyance guide 82 moves on the link arm slide rail 85 in the direction of the conveyance guide rotation axis 84 from the position when the recording medium passes as illustrated by a dashed line in FIG. 8. At this time, the other end of the link arm 81 that is fixed to the separating plate 83 lifts the separating plate 83 in the upper direction with the movement of the link arm 81 itself in the upper direction. Therefore, the separating plate 83 also moves on a separating plate slide rail 86 that is fixed to a fixing device side plate (not illustrated) or the like in the upper direction to a position for the jam elimination process as illustrated by a solid line.

In the embodiment illustrated in FIG. 8, the link interlocking mechanism 80 is arranged on the non-image surface side. However, the link interlocking mechanism(s) 80 may be arranged on the image surface side or on both of the sides and interlock the conveyance guide(s) and the separating plate(s) on the image surface side or on both of the sides with each other. Furthermore, the link interlocking mechanism 80 in which the conveyance guide 82 rotationally operates so as to open and close, and the separating plate 83 slidingly operates so as to open and close is described. However, any one or both of the conveyance guide 82 and the separating plate 83 may slidingly operate or rotationally operate so as to open and close as long as a link mechanism formed by the link arm 81, the link arm slide rail 85, the separating plate slide rail 86, and the like is used.

By using the link mechanism in such a manner, the conveyance guide 82 and the separating plate 83 are interlocked with each other reliably. Furthermore, restriction of the opening/closing operation of the separating plate 83 with the opening/closing operation of the conveyance guide 82 is small in terms of the space, so that arrangement design can be freely made in a narrow space.

According to the present invention, the separating plate on the image surface side opens and closes with opening/closing of the conveyance guide on the image surface side. Furthermore, the separating plate on the non-image surface side opens and closes with opening/closing of the conveyance guide on the non-image surface side. With these operations, a narrow fixing nip portion can be largely opened. Accordingly, even when jam occurs on the narrow fixing nip portion, a user or a service person can remove a recording medium reliably and immediately by opening these separating plates. Furthermore, the jam elimination process can be safely performed without directly touching the separating plates at high temperature.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A fixing device comprising:

a fixing member that heats a toner image on a recording medium, fixes the toner image onto the recording medium, and conveys the recording medium;

a heating member that heats the fixing member;

a pressing member that presses the fixing member to form a fixing nip portion;

a separating member on an image surface side that is arranged downstream of the fixing member in a conveyance direction and separates the recording medium from the fixing member;

a conveyance guiding member on the image surface side that is arranged downstream of the separating member on the image surface side in the conveyance direction;

a separating member on a non-image surface side that is arranged downstream of the pressing member in the conveyance direction and separates the recording medium from the pressing member; and a conveyance guiding member on the non-image surface side that is arranged downstream of the separating member on the non-image surface side in the conveyance direction, wherein the separating member on the image surface side is arranged so as not to make contact with an image range of the fixing member in a main-scanning direction, and when the conveyance guiding member on the image surface side is rotated about an axis of rotation thereof so as to be opened or closed, the separating member on the image surface side is also rotated or slid so as to be opened or closed simultaneously, and the separating member on the non-image surface side is arranged so as not to make contact with an image range of the pressing member in the main-scanning direction, and when the conveyance guiding member on the non-image surface side is rotated about an axis of rotation thereof so as to be opened or closed, the separating member on the non-image surface side is also rotated or slid so as to be opened or closed simultaneously.

2. The fixing device according to claim 1 further comprising a wire interlocking mechanism including a wire member and a tensioner that applies a tension to the wire member to interlock opening/closing of the conveyance guiding member on the image surface side and opening/closing of the separating member on the image surface side with each other.

3. The fixing device according to claim 1 further comprising a gear interlocking mechanism including a gear to interlock opening/closing of the conveyance guiding member on the image surface side and opening/closing of the separating member on the image surface side with each other.

4. The fixing device according to claim 1 further comprising a link interlocking mechanism including a link arm to interlock opening/closing of the conveyance guiding member on the image surface side and opening/closing of the separating member on the image surface side with each other.

5. The fixing device according to claim 1 further comprising a wire interlocking mechanism including a wire member and a tensioner that applies a tension to the wire member to interlock opening/closing of the conveyance guiding member on the non-image surface side and opening/closing of the separating member on the non-image surface side with each other.

6. The fixing device according to claim 1 further comprising a gear interlocking mechanism including a gear to interlocking opening/closing of the conveyance guiding member on the non-image surface side and opening/closing of the separating member on the non-image surface side with each other.

7. The fixing device according to claim 1 further comprising a link interlocking mechanism including a link arm to interlock opening/ closing of the conveyance guiding member on the non-image surface side and opening/closing of the separating member on the non-image surface side with each other.

8. The fixing device according to claim 1, wherein the conveyance guiding member on the image surface side and the conveyance guiding member on the non-image surface side rotate about axes of rotation thereof from positions when a recording medium passes to positions for a jam elimination process.

9. The fixing device according to claim 1, wherein the separating member on the image surface side and the separating member on the non-image surface side rotate from positions when a recording medium passes to positions for a jam elimination process with the rotation of the conveyance guiding member on the image surface side and the conveyance guiding member on the non-image surface side.

10. The fixing device according to claim 1, wherein the separating member on the image surface side and the separating member on the non-image surface side slide from positions when a recording medium passes to positions for a jam elimination process with the rotation of the conveyance guiding member on the image surface side and the conveyance guiding member on the non-image surface side.

11. An image forming apparatus comprising:

an image forming unit that forms a toner image onto a recording medium; and a fixing device that includes a fixing member that heats the toner image on the recording medium, fixes the toner image onto the recording medium, and conveys the recording medium;

a heating member that heats the fixing member;

a pressing member that presses the fixing member to form a fixing nip portion;

a separating member on an image surface side that is arranged downstream of the fixing member in a conveyance direction and separates the recording medium from the fixing member;

a conveyance guiding member on the image surface side that is arranged downstream of the separating member on the image surface side in the conveyance direction;

a separating member on a non-image surface side that is arranged downstream of the pressing member in the conveyance direction and separates the recording medium from the pressing member; and a conveyance guiding member on the non-image surface side that is arranged downstream of the separating member on the non-image surface side in the conveyance direction, wherein the separating member on the image surface side is arranged so as not to make contact with an image range of the fixing member in a main-scanning direction, and when the conveyance guiding member on the image surface side is rotated about an axis of rotation thereof so as to be opened or closed, the separating member on the image surface side is also rotated or slid so as to be opened or closed simultaneously, and the separating member on the non-image surface side is arranged so as not to make contact with an image range of the pressing member in the main-scanning direction, and when the conveyance guiding member on the non-image surface side is rotated about an axis of rotation thereof so as to be opened or closed, the separating member on the non-image surface side is also rotated or slid so as to be opened or closed simultaneously.

* * * * *